United States Patent [19]

Ware et al.

[11] Patent Number: 4,597,441

[45] Date of Patent: Jul. 1, 1986

[54] RECOVERY OF OIL BY IN SITU HYDROGENATION

[75] Inventors: Charles H. Ware, Roanoke; Leslie C. Rose, Rocky Mount, both of Va.; Joseph C. Allen, Bellaire, Tex.

[73] Assignee: World Energy Systems, Inc., Fort Worth, Tex.

[21] Appl. No.: 614,044

[22] Filed: May 25, 1984

[51] Int. Cl.[4] ..... E21B 43/24; E21B 43/243

[52] U.S. Cl. ..... 166/261; 166/263; 166/272; 166/303

[58] Field of Search ..... 166/303, 272, 260, 261, 166/59, 263, 302

[56] References Cited

U.S. PATENT DOCUMENTS

| | | | |
|---|---|---|---|
| 2,857,002 | 10/1958 | Pevere et al. | 166/303 |
| 3,051,235 | 8/1962 | Banks | 166/261 |
| 3,084,919 | 4/1963 | Slater | 166/261 X |
| 3,208,514 | 9/1965 | Dew et al. | 166/272 X |
| 3,259,186 | 7/1966 | Dietz | 166/263 |
| 3,285,335 | 11/1966 | Reistle, Jr. | 166/272 X |
| 3,327,782 | 6/1967 | Hujsak | 166/261 |
| 3,982,592 | 9/1976 | Hamrick et al. | 166/302 |
| 4,444,257 | 4/1984 | Stine | 166/303 X |
| 4,478,280 | 10/1984 | Hopkins et al. | 166/272 X |
| 4,495,994 | 1/1985 | Brown et al. | 166/272 X |

*Primary Examiner*—Stephen J. Novosad

*Attorney, Agent, or Firm*—Arthur F. Zobal

[57] ABSTRACT

In a method of recovering petroleum from underground formations penetrated by a production well, superheated steam and then hot hydrogen are injected by way of the well into a preheated formation zone next to the well. The hydrogen is injected under sufficient pressure to cause hydrogenation of the petroleum in the heated zone. The well is shut in and the hydrogen in the heated zone is allowed to "soak" for a period of time after which the pressure in the well is lowered and petroleum is recovered from the heated zone by way of the well. The cycle can be repeated a number of times.

By way of another well spaced from the production well, fluid under pressure is injected into said formations to drive petroleum in said formations between the two wells to the production well for recovery. Hydrogenation of the petroleum occurs as it is driven through the heated zone in the presence of the hydrogen therein.

41 Claims, 3 Drawing Figures

RECOVERY OF OIL BY IN SITU HYDROGENATION

BACKGROUND OF THE INVENTION

1. Field of the Invention

This invention is directed to a process of recovering petroleum from underground reservoirs.

2. Description of the Prior Art.

Some of the largest known liquid petroleum deposits in the world are the Athabasca tar sands located in northern Alberta. It has been estimated that this area alone contains approximately three hundred billion barrels of oil. Other huge deposits of a similar nature are to be found in various parts of the United States and in Venezuela. Owing to the highly viscous nature of these deposits, their economic production has been extremely difficult. Numerous processes have been employed in efforts to recover such material including processes involving mining and centrifuging the tar and sand in the presence of certain solvents and surface active agents and subjecting the mined tar and sand mixture to treatment with hot water and separating the resulting upper oil layer. These and other methods which have been used, however, all require large labor and capital expenditures.

Underground combustion and steaming as a means of recovering deposits of this type have also been employed. In general, however, the very high differential pressures that must be applied between input and producing wells to recover the oil presents an extremely difficult problem. Frequently, the pressures that must be applied to shallow reservoirs of low permeability, i.e., less than 100 millidarcies, are higher than can either be applied economically or without causing uncontolled fracturing of the formation which would lead to channeling or bypassing, or both.

Conventional underground combustion, i.e., an operation in which the combustion zone is propagated from a point near the face of an injection well toward a producing well, is extremely difficult with heavy viscous hydrocarbons in low permeability reservoirs of the type contemplated herein. Production is difficult in low-permeability reservoirs because the produced oil flows from the hot zone through the unheated zone to the production well. In the combustion zone the viscosity of the oil is at a minimum; however, as the pressure of the system forces the oil toward the producing well, the oil decreases in temperature to that of the unburned portion of the reservoir. Eventually, resistance to flow through the reservoir to the producing well becomes so great that combustion can no longer continue because it is impossible to supply air at a satisfactory rate to the burning zone.

The following U.S. Patents disclose various systems for and methods recovering petroleum from underground formations: U.S. Pat. Nos. 3,327,782, 3,208,514, 3,982,591, 3,982,592, 4,024,912, 4,050,515, 4,077,469, 4,078,613, 4,183,405, 4,199,024, and 4,241,790.

U.S. Pat. Nos. 3,208,514 and 3,327,782 disclose in situ hydrogenation of heavy oil and tar sands based upon achieving hydrogenation temperatures by means of in situ combustion. The use of this technique presents a significant difficulty. In order for hydrogenation of heavy oil or tar sands to take place, it is necessary to contact the oil with heat and hydrogen for a sufficient length of time so that enough of the reaction can take place to upgrade the oil so that it can be produced. In situ combustion is a flow process and by its very nature tends to displace the oil in the formation. When forward combustion is stopped at any point there is a series of zones in the formation, each with its own characteristic temperature. Residual oil displacement areas are shown in FIG. 1 of the present application. Flow starts at the injection well and moves towards a production well. For forward dry combustion these zones are as follows:

Zone 1. (surrounding the wellbore of the injection well) high temperature (300°–800° F.); no oil; no water.

Zone 2. (combustion zone) very high temperature (typically 800°–1000° F. depending upon the permeability of the formation and the original oil and water saturations); steep oil gradient—oil at the boundary with the first zone and 10–20% oil saturation at the other zone boundary; no water as such.

Zone 3. (steam chest) steep temperature gradient from the combustion zone temperature to the temperature for condensing steam at the formation pressure, typically 450°–550° F. for pressures of 400 to 1000 psig; oil saturations of 10–20%; water saturations of up to 80–90%.

Zone 4. (hot water zone) temperatures declining from that at the boundary of zone 3 to formation temperature, oil saturations increasing from 10–20% up to original oil saturations and water saturations decreasing from about 80°–90° at the boundary of zones 3 and 4 to original water saturations.

The oil which is in zone 2 has been distilled and is least susceptible to hydrogenation; it will not be produced because it is in the combustion zone. The same is true of the oil in zone 3 and the combustion zone will soon overtake it. The oil in zone 4 is suitable for hydrogenation but the temperatures there are at most the condensation temperature of steam.

Regardless of when the combustion is stopped and the hydrogen introduced, little or no oil will be at the temperature suitable for hydrogenation; temperatures below 550° F. result in hydrogenation rates which are too slow to be economical. Therefore, dry in situ combustion is not satisfactory for heating the oil in place to hydrogenation temperatures. Similar problems exist with forward wet combustion; it has the additional difficulty that the maximum formation temperatures which it creates are lower than those created by dry combustion.

U.S. Pat. No. 3,327,782 discloses a hydrogenation method for recovery of oil and upgrading the quality of viscous oils based upon heating the formation by means of reverse combustion using air. This has two significant drawbacks:

1. In low permeability reservoirs, it is difficult or, in some cases, impossible to maintain the gas fluxes necessary to achieve burn rates that will heat the formation to the temperatures required for hydrogenation—550° to 900° F.;

2. When using air as the combustion-supporting gas, the resulting partial pressure of the residual nitrogen will be above the original reservoir pressure. In order for hydrogenation to take place at significant rates, the hydrogen partial pressure must be at least 300 psi and preferrably greater than 500 psi. Therefore, it would be difficult, in most cases, to achieve this partial pressure without causing random fracturing of the reservoir overburden and the resulting escape of hydrogen. If hydrogen is used to displace the nitrogen, channeling will occur and only a fraction of the nitrogen will be removed; the result of this will be to have hydrogenation conditions existing in small random pockets of the formation. If the nitrogen is removed by reducing the reservoir pressure, water which had condensed in the formation during the heating step will evaporate and cool the formation to the saturation temperature at the formation pressure. This temperature reduction along with the expansion of the nitrogen and hydrogen will reduce the formation temperature well below that required for economical rates of hydrogenation.

In the process of U.S. Pat. No. 3,327,782, there is hydrogen flow through the formations from the injection well to the production wells. This results in low efficiency for the effective use (uptake) of the hydrogen that has been injected and a major economic cost in terms of lost hydrogen and/or hydrogen recovery from the produced gas.

The process of this patent also requires either a formation having a low permeability less than 100 millidarcies, or, in higher permeability reservoirs, the use of in situ combustion for heat generation. In addition the process might leave uncontrolled quantities of residual oxygen in the formation including oxygenates resulting from incomplete combustion of the oil and free oxygen in the gas saturation. When hydrogen is introduced, the unknown and uncontrolled quantities of oxygen will combine with the hydrogen at the wrong place and time in the process, thereby reducing the hydrogen partial pressure and the effectiveness of the hydrogenation step.

U.S. Pat. No. 3,982,592 discloses a gas generator that may be operated to thermally crack the hydrocarbons (in the formation) into lighter segments for reaction with excess hot hydrogen to form lighter and less viscous end products and to hydrogenate or cause hydrogenolysis of unsaturated hydrocarbons to upgrade their qualities for end use. The term hydrogenation herein is defined as the addition of hydrogen to the oil without cracking and hydrogenolysis is defined as hydrogenation with simultaneous cracking. Cracking is herein defined as the breaking of the carbon bonds with a resulting reduction of the weight of the molecules. The flow of hydrogen and oxygen to the gas generator is controlled to maintain the termperature of the gases flowing through the outlet at a level sufficient to cause hydrogenation of the hydrocarbons in the formations. The cracked gases and liquids move through the formations to a spaced production well for recovery at the surface. Operation of the gas generator provides for a temperature at the outlet of the generator which is sufficient to cause hydrogenation, but the patent does not teach how to effectively contact oil, heat, and hydrogen simultaneously.

U.S. Pat. Nos. 4,183,405 and 4,241,790 also disclose the flow of hydrogen through the formations from an injection well to a production well and also the use of insitu combustion to generate enough heat for hydrogenation to take place and for distillation and cracking purposes.

SUMMARY OF THE INVENTION

It is an object of the invention to provide a new and useful process of recovering petroleum from underground reservoirs or formations.

It is a further object of the invention to recover petroleum from underground reservoir formations wherein oil, heat, and hydrogen are contacted simultaneously in the reservoir formation to effectively carry out hydrogenation and/or hydrogenolysis to enhance recovery of the oil.

In carrying out one embodiment of the process, a production well is employed which penetrates the reservoir formation. By way of said well, a gas comprising hydrogen is injected into a reservoir formation zone next to said well. The gas injected has a temperature within the range of from about 350° F. to about 900° F. The injection of the gas is continued until sufficient pressure is achieved to cause hydrogenation of the petroleum in said formation zone. The injection of the gas is terminated; the pressure in said production well is lowered and fluids comprising treated oil are recovered from said formation zone by way of said production well.

In the preferred embodiment, the reservoir formation around said production well is preheated by the injection of saturated steam through the production well and fluids comprising primarily water are produced. Next superheated steam and then hydrogen at the same temperature as the superheated steam are injected into the preheated zone. Prior to lowering the pressure in the production well, for production purposes, sufficient pressure is maintained in the well to retain the hydrogen in the heated formation zone in contact with the petroleum therein for "soaking" purposes for a given period of time. Following this phase of the process, by way of another well penetrating said reservoir formation and spaced from said production well, a fluid under pressure is injected into the formation to drive fluids including petroleum in said formations between said other well and said production well, to said production well. The petroleum in said formation between said other well and said production well that is driven through said heated formation zone and in the presence of hydrogen therein causes hydrogenation of said petroleum as it is being driven through said heated formation zone to said production well. Preferrably the drive employed is a steam drive formed by either injecting steam into said other well or carrying out in situ combustion followed by the injection of water which forms steam upon contact of the hot rocks in the formations. Additional hot hydrogen can be injected into said production well to insure a sufficient amount of hydrogen for hydrogenation purposes in said heated formation zone next to said production well. Petroleum driven to said production well then is recovered.

In another embodiment an auxiliary well which penetrates the heated formation zone near said production well is used for recovering the treated petroleum.

DESCRIPTION OF THE PREFERRED EMBODIMENTS

Figure 1:
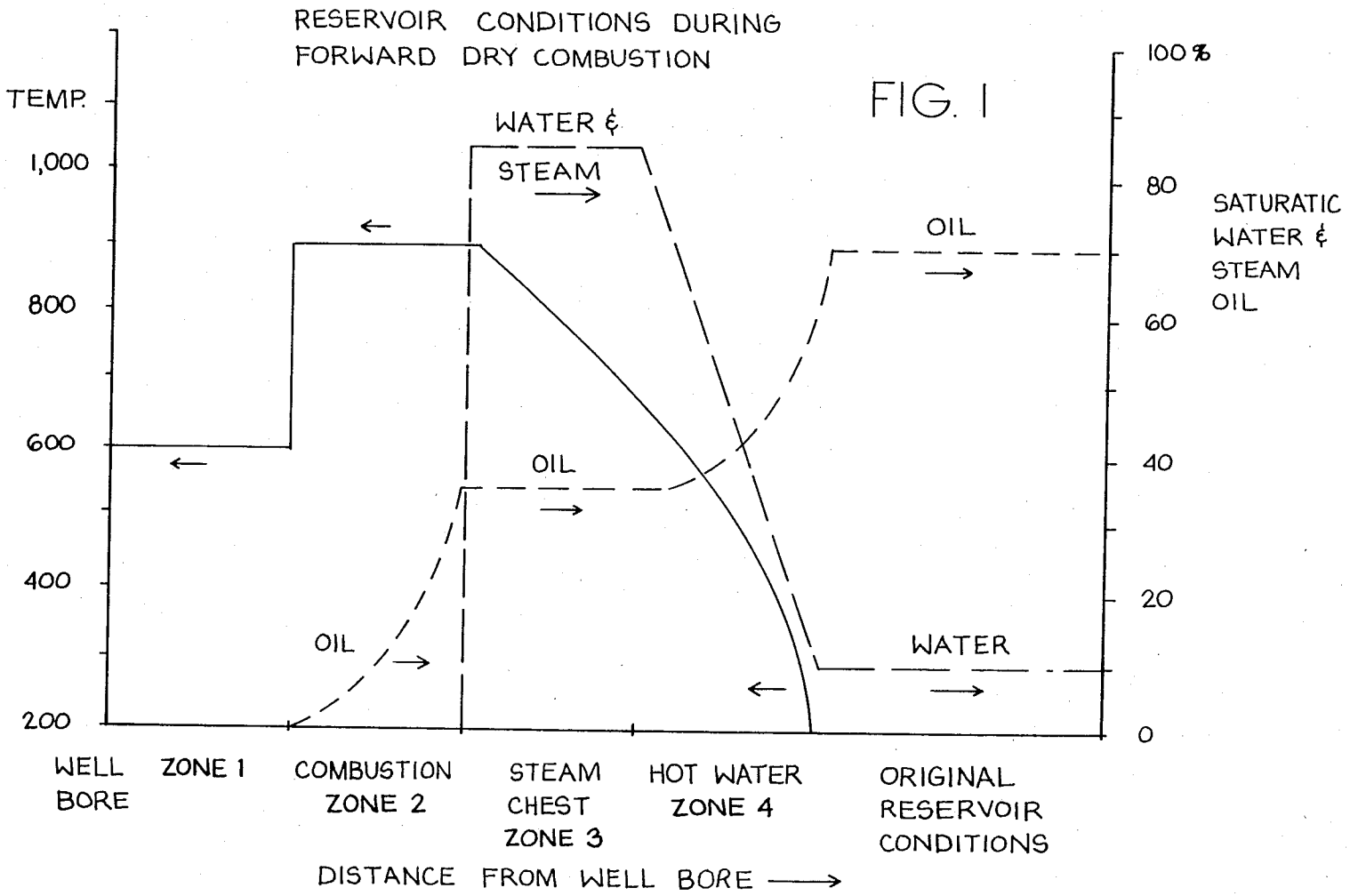
FIG. 1 curves illustrating reservoir conditions during forward drive combustion.
Figure 2:
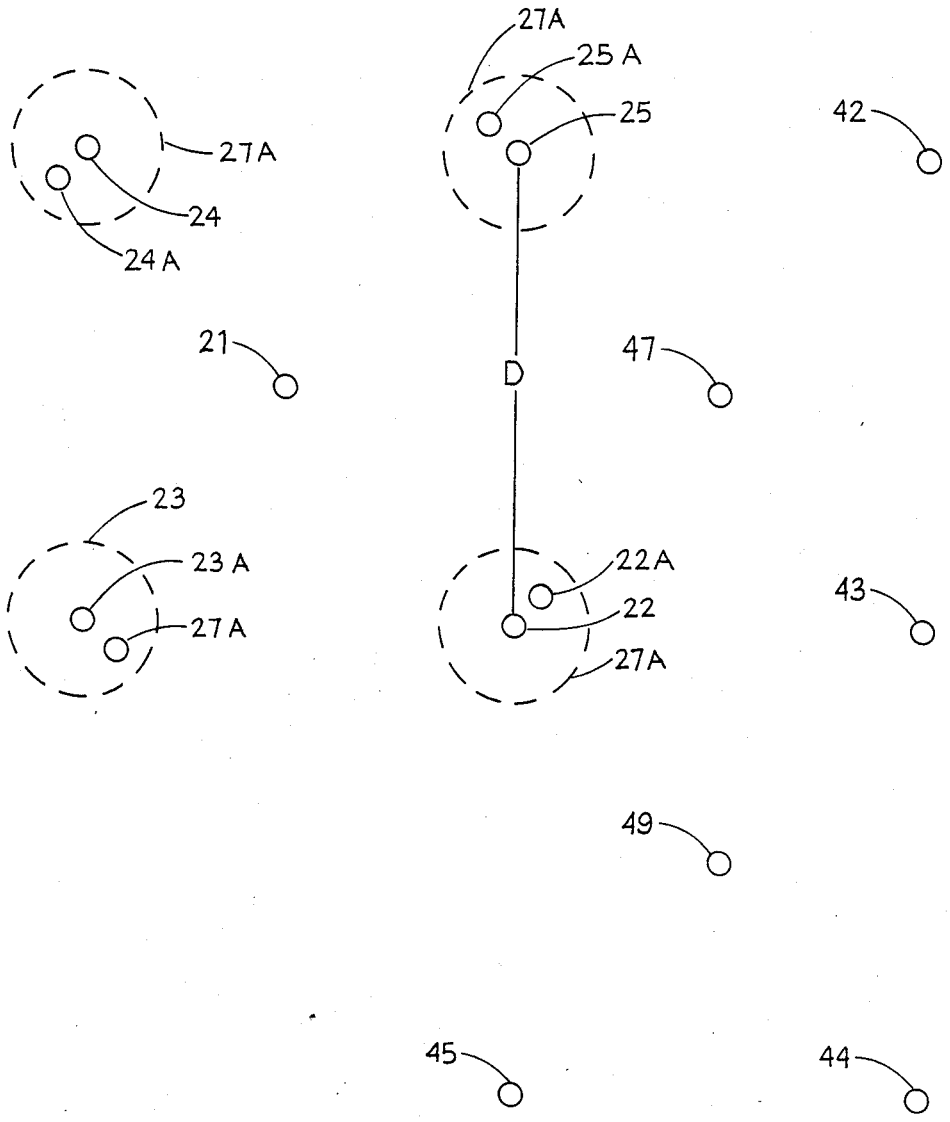
FIG. 2 is a plan view of injection wells and surrounding production wells employed for carrying out the invention.
Figure 3:
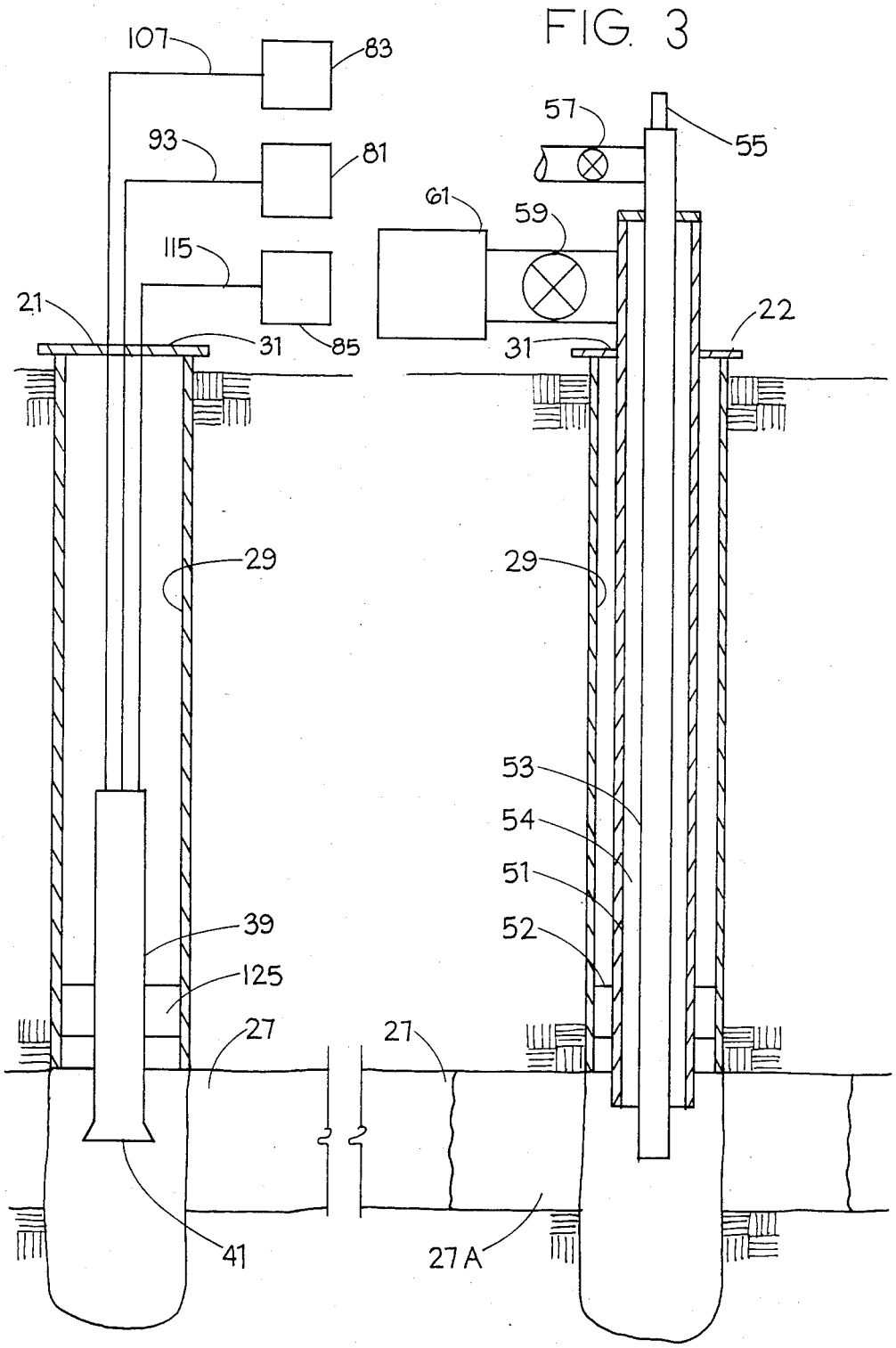
FIG. 3 is a cross section of the earth formations illustrating a central injection well and one of the production wells.

Referring now to the drawings, FIG. 2 illustrates a pattern of five wells 21–25 which may be employed to carry out the invention. Well 21 is defined as the central injection well and wells 22–25 are defined as peripheral production wells. The invention is not limited to the use of any particular pattern of wells nor with a plurality of production wells, however, the use of a plurality of production wells makes the process of the invention more economical. The wells are drilled into the formations from the surface and penetrate a subsurface petroleum bearing formation or reservoir illustrated at 27 in FIG. 3. Each of the wells is lined with steel casing 29 and has an upper well head 31. The casing may extend down to the level of the reservoir formation 27 as shown in FIG. 3 or below the formation 27, in which case the casing will be perforated to provide fluid communication between the wells and the formation 27.

Preferably the invention is used for recovering petroleum from tar sands or from a reservoir of viscous oil such as that having an API gravity in excess of −10°. It is to be understood that the invention may be used to recover petroleum from reservoirs of less viscous oil.

In carrying out the preferred embodiment of the process of the invention, saturated steam is injected from the surface into wells 21–25 for a given period of time, for example, from two to fourteen days. Water next will be produced from wells 21–25 for a given period of time, for example, for up to 128 days. Production of fluids from the wells will be terminated when a significant amount of oil begins to appear. It is not desired to produce oil at this time but to treat the oil as will be described subsequently before production of the oil. The preliminary process of steam injection and production of water is a conventional process known as "huff and puff." In this invention, the huff and puff process is employed to preheat and open up the reservoir around the wells, for example, in zones extending from about three to ten feet outward from the production wells. The heated zones are illustrated at 27A.

Next, superheated steam and enough hydrogen to keep the oil from degrading are injected into the reservoir 27 by way of wells 22–25. The injection of the superheated steam may be carried out for a period of time of from about a week to a year. The superheated steam raises the temperature of the preheated zones in the reservoir 27 around the wells 22–25 and vaporizes the water in these zones. The superheated steam thus creates void spaces in the preheated zones in the reservoir 27 around the wells 22–25 which will result in gas saturation. Hot hydrogen and some superheated steam then are injected into the reservoir by way of wells 22–25. The hydrogen preferrably will be at the same temperature as the superheated steam and will be injected for a period of time of from about one to twenty days. The superheated steam and hot hydrogen increase the temperature and pressure in the reservoir in the preheated zones around the wells 22–25 such that the hydrogen will cause hydrogenation and/or hydrogenolysis of the oil thereby reducing its viscosity and increasing its API gravity.

At pressures of, for example, 400 to 2,000 PSI and at temperatures of, for example, 300° to 900° F., hydrogenation and/or hydrogenolysis of the oil in place can be effected, causing a decrease in oil viscosity and thus rendering possible the recovery of viscous oil or oil from tar sands by conventional secondary methods. Temperatures of 350° F. to 900° F. thus should be employed, however, temperatures of the order from about 550° F. to 700° F. are preferred. The temperature should be below that at which excessive decomposition of petroleum occurs.

The pressure used in carrying out the process may vary widely, depending on a number of conditions, such as the permeability of the reservoir, the hydrogenation zone temperature, and hot gas or fluid injection rates, etc. The pressure employed in the process should be higher than prevailing reservoir pressure, but lower than that which would cause uncontrolled fracturing of the formation and undesirable channeling and bypassing of the injected materials. High pressures favor a more complete hydrogenolysis of the heavier hydrocarbon fractions. Pressure of from about 300 to about 1200 PSI are typical of those which may be employed. Thus the superheated steam and hot hydrogen are injected into the reservoir 27 by way of wells 22–25 until the desired values of temperature and pressure are reached in the preheated zones surrounding wells 22–25 sufficient for hydrogenation and/or hydrogenolysis of the oil to take place but less than the undesired limits of temperature and pressure which could cause excessive decomposition of petroleum or fracturing of the formations.

After the superheated hydrogen is injected, the hydrogen should ordinarily be allowed to remain in contact with the viscous oil or tar at reservoir conditions resulting from the heat treatment until samples taken periodically from the producing wells 22–25 show that the produced oil viscosity is low enough considering the temperature, porosity, and pressure of the formation to obtain economical oil production. Depending on the conditions of the reservoir and the characteristics of the oil, the time of contact of hydrogen with the oil may vary widely, for example, from about one day to seven days or a month, or even longer. This period is known as a "hydrogen soak" period.

Generally speaking, the hydrogen should be introduced into the formation, typically at the rate of 70,000–2,000,000 standard cubic feet per day per production well, until the pressure in the production well reaches the desired limit. Thereafter, the hydrogen should be sufficient to maintain adequate pressure in the production well or wells. As the hydrogen is absorbed into the oil, the pressure will decrease and more hydrogen can be injected. The hydrogen soak period should be maintained for at least about one day. While periods of seven to ten days for the hydrogen to remain in contact with the viscous oil are generally preferred, an improvement in quality of the oil can be secured if production is begun shortly, i.e. within a matter of days, after hydrogen is first injected into the formation. Under the above circumstances, large quantities of hydrogen will remain in the reservoir in contact with the oil at high temperatures, particularly in the portion of the reservoir nearest the well bore. This condition, coupled with substantial reservoir pressures, assists materially in effecting hydrogenation and/or hydrogenolysis of oil in accordance with the process of the invention.

After the oil, hydrogen, and heat have been in contact for a time sufficient for the oil to react with the hydrogen via hydrogenation, or hydrogenolysis, or both, the oil is ready to be produced. This can be accomplished by lowering the pressure in the production wells. The hydrogen which is in solution will evolve and occupy 1.5 to 10 times the volume of the oil from which it evolved, the exact quantity of hydrogen being dependent upon the temperature and pressure in the formation before and after the pressure is lowered. When the pressure in the production wells is lowered, the gas which is released from the oil and surrounding the production wells will push the oil in a direction of the lowest pressure, that is, toward the production wells. In this fashion, the oil will be produced.

Thus the huff and puff process preheats the reservoir around the production wells with relatively inexpensive saturated steam and enhances the distance that superheated steam can be injected outward from the wells 22–25 and also the vaporization of the water by the superheated steam. The injection of the superheated steam also enhances the distance that hot hydrogen can be injected into the reservoir around the wells 22–25 and also the extent of hydrogenation and/or hydrogenolysis of the oil. The superheated steam and hot hydrogen add additional heat to the preheated reservoir without displacing the oil to the extent which would occur if merely saturated steam were employed. This is due to the fact that superheated steam is "bone dry" and hence does not create much condensate whereas saturated steam would create a considerable amount of condensate which would tend to push or displace the oil away from the heat. Thus the use of superheated steam and hot hydrogen allow oil, heat, and hydrogen to simultaneously be contacted thereby enhancing hydrogenation and/or hydrogenolysis.

When the wells 22–25 are placed on production, a mixture of treated oil, water, steam, and gas which was in the reservoir, if any, and unused hydrogen will be produced. The treated oil will have improved properties of lower viscosity, higher API gravity, possibly reduced sulphur and possibly reduced nitrogen. After the oil has been produced and is no longer flowing at an economical rate from wells 22–25, the injection of superheated steam and hot hydrogen, soak, and then production may be repeated to produce additional quantities of oil. During the second cycle, the injection of superheated steam and hot hydrogen will extend the radius of treatment by another increment. As a result of the injection of super heated steam during the first cycle, gas saturation will have resulted. Residual hydrogen will remain in the formation which will make the penetration of the superheated steam in the second cycle, faster whereby the steam will be able to heat further out into the formation. The injection of superheated steam and then hot hydrogen, soak, and production from the production wells can be carried out a third and fourth time until some economic limit is reached whereby the first phase of the process will be completed. As the cycles are repeated, the reservoir surrounding the production wells have an increasing gas saturation and an increasing permeability.

After one or more of the cycles of the first phase have been completed, conventional fluid drive initiated from the injection well 21 can be carried out to produce oil at the production wells. The fluid drive may comprise steam flooding carried out by injecting steam into the reservoir 27 by way of the well 21. The steam then will flow outward from the well 21 toward the wells 22–25 driving the oil toward the production wells 22–25. As an alternative, a forward combustion drive may be initiated from the injection well 21 by injecting oxygen or air along with steam into the reservoir 27 by way of the injection well 21. The oxygen or air will cause the petroleum products in the reservoir 27 to be spontaneously ignited due to the heat and pressure in the formation 27 around the injection well 21. Alternatively ignition can be achieved using an igniter, for example, an electric heater. Some of the oil in place will burn with the result that the temperature in the formation surrounding the well will be raised. Upon the continued injection of oxygen or air, the flame front and the expanding gases will push the oil outward toward the production wells 22–25 which then is recovered. Prior to combustion, steam may be injected into the injection well 21 to move the oil away from the well bore to clean up the area around the well bore so that the oil will not burn immediately around the well 21 when oxygen or air is injected. Following the forward combustion drive, water then can be injected through the injection well 21 to create steam in the reservoir 27 as it contacts the hot rock to drive the remaining oil to the production wells 22–25. The water thus will scavenge the remaining heat in the formation. As a further alternative, carbon dioxide, propane, natural gas, propane, ethane, hydrocarbons from the group $C_4$ to $C_{20}$, light petroleum fractions boiling up to saturated steam temperature at the reservoir pressure, or other fluids can be injected through the injection well 21 to decrease the viscosity of the oil and to increase production. The pressure of these fluids causes the oil to be driven to the production wells 22–25.

The fluid drive will push the oil back over the heat treated zones around the production wells 22–25 thereby causing additional hydrogenation and/or hydrogenolysis of the oil to occur as it passes through the heated zones 27A to the production well 22–25.

The oil produced from the production wells 22–25 can be sampled during the fluid drive stage and if it is found that the produced oil has not been treated sufficiently, hot hydrogen may be injected into the reservoir 27 through the production wells 22–25 to lower the viscosity of the oil to make it more readily producible and to increase the quality of the oil while it is in the reservoir and before recovery.

A complete production cycle comprising the two phases of the process may take 3½ to 5 years to complete. At any time during either phase of the process, four more production wells 42–45 and two more injection wells 47 and 49 may be drilled such that they penetrate the reservoir 27. When the production cycle has been completed for the well pattern 21–25, the two phase production cycle can be started for the well pattern comprising production wells 22, 25, 42, and 43 and injection well 47 and for the well pattern comprising production wells 43, 44, 45, and 22 and injection well 49. In this manner, the patterns can be expanded until a steady state operation is reached such that as one pattern is phased out, a new pattern is initiated. As a specific project progresses, one portion of the field can be produced while another portion is undergoing hydrogenation treatment and still a third section of the field is undergoing hydrogen and temperature soak, etc.

The hydrogen used in the process may be obtained from a variety of sources. In general, it is preferable to prepare it by well known methods, such as reforming or noncatalytic partial oxidation. The fuel for manufacture of hydrogen by such methods may be a gas fraction or a liquid fraction from the produced oil, or the gas or coke produced from thermal cracking of the viscous oil or tar. Cracking occurs to some extent in the formation, depending, of course, on the temperature. However, the lighter oil fractions may be separated from the oil produced and used as a reformer fuel in a known manner. An impure hydrogen stream such as that obtained by reforming without carbon dioxide removal may be employed in the inplace hydrogenolysis process. In some instances, carbon dioxide removal, or partial removal, by any of the well known methods may be advisable.

The reformer product, which contains approximately 35 to 65 percent hydrogen, may be injected directly into the formation since the normal remaining impurities do not interfere to any substantial degree with the desired hydrogenolysis reaction. However, the hydrogen partial pressure in the formation must be high enough to maintain the desired hydrogenation and hydrogenolysis reactions. The gas from producing wells should contain an appreciable amount of hydrogen together with light gaseous hydrocarbons. This gaseous product can be used as a reformer feed to produce additional hydrogen for the process. As an alternative to the reforming methods of hydrogen production, there may be employed partial oxidation of any or all fractions of the produced oil; the hydrogen, CO, $CO_2$, $H_2S$ mixture may be further processed to produce a stream which is more or less pure hydrogen. While one or more wells are producing oil and gaseous hydrogen and one or more wells are receiving hydrogen, the produced hydrogen may be separated from the light hydrocarbon gases which are produced with it and a relatively pure stream of gaseous hydrogen produced. The gaseous hydrogen may be compressed and used for injection or may be compressed and stored for use in later injection cycles.

The saturated steam employed is medium quality steam with something in the neighborhood of 30%-80% steam mixed with water. Superheated steam is defined herein as steam at a temPerature above that at which the steam will condense at a given pressure. For example, at 1000 PSI absolute pressure, the steam condenses at 544° F. Thus at this pressure, superheated steam is steam having a temperature above 544° F.

There now will be described more details of the wells and the equipment for carrying out the process of the invention. The pattern formed by wells 22-25 as shown is a square (having sides equal to a distance D) although it is to be understood that different patterns may be formed by the production wells. In one embodiment, the distance D may be equal to about 460 feet with the injection well 21 located centrally of the square pattern formed by production wells 22-25. It is to be understood that the space between the production wells may be greater or less than 460 feet.

Wells 22A-25A are auxiliary wells located close to their associated peripheral production wells 22-25 respectively. The auxiliary wells penetrate the reservoir 27 and are located such that they will be within the heated zones 27A surrounding their associated production wells. For example, well 22A may be located three to ten feet or more from well 22 depending upon how far out its heated zone 27A is expected to extend. The auxiliary wells are lined with casing in the same manner as their associated production wells. The auxiliary wells may or may not be used in carrying out the process of the invention depending upon the circumstances.

One manner in which the huff and puff process can be carried out is by locating a conduit 51 in the wells 21-25 with a packer 52 located between the conduit 51 and the casing 29 at a level slightly above the reservoir formation 27. The packer 52 may be an inflatable type of packer as disclosed U.S. Pat. Nos. 3,982,591, 3,982,592, and 4,199,024. Extending through the conduit 51 is a production tube 53 through which the sucker rod 55 of a walking beam type of pump extends. Steam will be injected into the reservoir 27 through the annulus 54 formed between the conduit 51 and the production tubing 53. In the injection of steam, the pump will be shut down, valve 57 will be closed, and valve 59 opened to allow saturated steam to be injected into the annulus 54 from a source of steam 61. The injection of saturated steam from the surface during this portion of the cycle is desired since this provides a relatively inexpensive source of steam for preheating the reservoir around the wells. After the steam injection portion of the huff and puff cycle, the fluids can be removed from the formation by closing valve 59, opening valve 57, and operating the pump to produce fluids through the production tubing 53 and valve 57. The use of the huff and puff process is preferred since it preheats the formation surrounding the wells with inexpensive heat and opens up the reservoir surrounding the wells. In some cases, however, the huff and puff process may not be necessary, particularly if the reservoir has already been preheated by other secondary recovery process. The removal of fluids from the reservoirs after the injection of the saturated steam is preferred, however, in all cases, this may not be necessary.

After the huff and puff process is completed, the packer 52, the conduit 51 and the production tubing 53 including the associated pumping equipment will be removed from the wells and a gas generator of the type disclosed in U.S. Pat. Nos. 3,982,591, 3,982,592 or 4,199,024 inserted in all of the production wells 22-25 and in the injection well 21. A gas generator of this type is illustrated at 39 in well 21. All of the components of the gas generator 39 are not shown in the drawings of this application and reference is hereby made to U.S. Pat. Nos. 3,982,591, 3,982,592, and 4,199,024 for a detailed description of such a gas generator. These three patents are hereby incorporated into this application by reference. The gas generator comprises an inflatable packer 125; a source of hydrogen 81 with a supply line 93 extending from the source 81 to the generator 39; and a source of oxygen 83 with an oxygen supply line 107 extending from the source 83 to the gas generator. In operation, hydrogen and oxygen are supplied to the gas generator 39; ignited and burned to produce steam which flows through its outlet 41. As disclosed in the three above identified patents, the gas generator can be cooled by water supplied thereto from the well bore. In using the gas generator in the preferred embodiment of this invention, saturated steam is employed for cooling gas generator. The saturated steam is injected into the chamber of the gas generator from an uphole source 85 and an insulated supply line 115. In the operation of the gas generator, the saturated steam injected downhole into the gas generator is heated to a temperature sufficient to form superheated steam. This forms a relative inexpensive way to obtain superheated steam downhole since relatively inexpensive steam is produced uphole and the expensive heat is added to the steam downhole. It is to be understood that superheated steam could be produced uphole and injected into the gas generator or the gas generator could be operated with hydrogen, oxygen and water to produce superheated steam downhole. The gas generator can be operated to produce primarily superheated steam and some excess of hot hydrogen or can be operated to produce a large amount of excess hot hydrogen and a lesser amount of superheated steam. In carrying out the portion of the process wherein superheated steam and then hot hydrogen are injected into the reservoir, the gas generator is operated to produce superheated steam and a small amount of hydrogen for a period of between a week and a year and then it is operated to produce a larger amount of excess amount of hydrogen and a smaller amount of steam for the period of from one to twenty days. It is to be understood that superheated steam and an excess amount of hydrogen could be injected during these periods at the same time but this would be a more expensive process since it involves injection of a large amount of hydrogen for an extended period of time. The purpose of the superheated steam initially is to add additional heat and prepare the extent of the zone around the production wells for the injection of the hot hydrogen. The hydrogen injected from the gas generator will be heated by the superheated steam to the temperature of the superheated steam. The gas generator will be operated to produce the high temperature gases having temperatures corresponding to superheated steam and of the order of 350° F. to 900° F. and preferrably of the order of from about 500° F. to about 700° F. as described above, depending upon the pressure employed.

The gas generators in all of the production wells will be operated simultaneously to inject superheated steam and then hot hydrogen at the temperature of the superheated steam. During this period, the gas generator in the injection well will not be operated. After the superheated steam and hot hydrogen have been injected and the soak period carried out, the gas generators 39 can then be removed from the production wells 22–25 and production tubing and associated pumping equipment inserted into wells 22–25 to produce the treated oil from the production wells 22–25. In the alternative, the gas generators 39 may be left in wells 22–25 and production tubing and associated pumping equipment inserted into auxiliary wells 22A–25A for the production of the treated oil.

During the fluid drive process from the injection well 21, the gas generator in the injection well can be operated to produce saturated steam. For the forward combustion drive, air or oxygen can be injected under pressure into the reservoir through the gas generator while it is not operating in its burning mode. If other fluids are used for the fluid drive process, such as carbon dioxide, propane, natural gas, etc., as mentioned above, these fluids can be injected into the formation through the gas generator in the injection well when the gas generator is not operating in its burning mode. During the fluid drive process and assuming that production tubing and pumping equipment are located in wells 22–25 for the removal of treated oil, hot hydrogen may be injected into the reservoir 27 around the wells 22–25 if additional hot hydrogen is needed, by injecting the hot hydrogen from the surface by way of the annulus between the production tubing and the casing of the wells. During the fluid drive process and assuming that the gas generators are located in the production wells 22–25 and fluids are being produced from the auxiliary wells, the gas generators may be operated to produce an excess amount of hot hydrogen for injection into the reservoir 27 adjacent the production wells 22–25 if additional hot hydrogen is needed during this process. Hot hydrogen also may be injected into the reservoir 27 by way of the auxiliary wells, if needed, during the fluid drive process.

In the operation of the gas generator, the temperatures of the gases produced by the gas generator can be determined from calculation based upon the amount of hydrogen and oxygen burned. In addition, the downhole gas pressures can be determined by calculations based upon the amount of hydrogen and oxygen fed to the gas generator. The fracture pressures of the overburden formations above the reservoir 27 can also be determined by calculations based upon industry standards and the depth of the reservoir 27.

We claim:

1. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone bydrogen having a temperature within a range of from about 350° F. to about 900° F., continuing to inject said hydrogen until sufficient pressure is achieved to cause hydrogenation of the petroleum in said formation zone, terminating the injection of said hydrogen, recovering fluids including petroleum from said formation zone by way of said well, by way of another well penetrating said formations and spaced from said production well, injecting into said formations, fluid to drive fluids including petroleum in said formations between said other well and said production well, to said production well, said petroleum in said formations between said other well and said production well being driven through said formation zone, while said formation zone is in a heated condition and in the presence of hydrogen therein to cause hydrogenation of said petroleum as it is being driven through said formation zone to said production well, injecting additional hydrogen into said formation zone by way of said production well to enhance hydrogenation of said petroleum as it is being driven through said formation zone to said production well, and by way of said production well, recovering said petroleum driven to said production well.

2. A method of recovering petroleum from underground formations penetrated by a production well, comprising the steps of:

by way of said well, injecting steam into an underground formation zone next to said well, terminating the injection of said steam and recovering fluids from said well, by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the petroleum in said formation zone, terminating the injection of said hydrogen, and recovering fluids including petroleum from said formation zone by way of said well.

3. The method of claim 2 wherein after said fluids are recovered from said formation zone by way of said production well, said method comprising the steps of:

by way of another well penetrating said formations and spaced from said production well, injecting into said formations, fluid to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

4. The method of claim 3 wherein after said fluids are recovered from said formation zone by way of said production well, injecting additional hydrogen into said formation zone by way of said production well to enhance hydrogenation of said petroleum as it is being driven through said formation zone to said production well.

5. A method of recovering petroleum from underground formations, comprising the steps of:

by way of a first well penetrating said formation, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, recovering fluids including petroleum from said formation zone by way of a second well which penetrates said formation zone, by way of another well, penetrating said formations and spaced from said second well, injecting into said formations, fluid to drive fluids including petroleum in said formations between said other well and said second well, to said second well, said petroleum in said formations between said other well and said second well being driven through said formation zone, while said formation zone is in a heated condition, and in the presence of hydrogen therein to cause hydrogenation of said petroleum as it is being driven through said formation zone to said second well, and by way of said second well, recovering said petroleum driven to said second well.

6. The method claim 5 wherein after said fluids are recovered from said formation zone by way of said second well, injecting additional hydrogen into said formation zone by way of said first well or said second well to enhance hydrogenation of said petroleum as it is bring driven through said formation zone to said second well.

7. A method of recovering petroleum from underground formations, comprising the steps of:

by way of a first well, injecting into an underground formation zone next to said well, superheated steam having a temperature within a range of from about 350° F. to about 900° F., reducing the amount of superheated steam injected and injecting into said underground formation zone by way of said well, hydrogen heated to a temperature of superheated steam, continuing to inject said hydrogen until sufficient pressure is achieved to cause hydrogenation of the petroleum in said formation zone, recovering fluids including petroleum from said formation zone by way of a second well penetrating said formation zone, by way of another well penetrating said formations and spaced from said second well, injecting into said formations, fluid to drive fluids including petroleum in said formations between said other well and said second well, to said second well, said petroleum in said formations between said other well and said second well being driven through said formation zone, while said formation zone is in a heated condition, and in the presence of hydrogen therein to cause hydrogenation of said petroleum as it is being driven through said formation zone to said second well, and by way of said second well, recovering petroleum driven to said second well.

8. The method of claim 7 wherein after said fluids are recovered from said formation zone by way of said second well, injecting additional hydrogen into said formation zone by way of said second well to enhance hydrogenation of said petroleum as it is being driven through said formation zone to said second well.

9. A method of recovering petroleum from underground formations, comprising the steps of:

by way of a first well, injecting steam into an underground formation zone next to said well, recovering fluids from a second well penetrating said formation zone, by way of said first well, injecting into said formation zone, superheated steam having a temperature within a range of from about 350° F. to about 900° F., reducing the amount of steam injected and by way of said first well, and injecting into said formation zone, hydrogen heated to a temperature of superheated steam, continuing to inject said hydrogen until sufficient pressure is achieved to cause hydrogenation of the petroleum in said formation zone, and recovering fluids including petroleum from said formation zone by way of said second well.

10. The method of claim 9 wherein after said fluids are recovered form said formation zone by way of said second well, said method comprising the steps of:

by way of another well penetrating said formations and spaced from said second well, injecting into said formations, fluid to drive fluids including petroleum in said formations between said other well and said second well, to said second well, said petroleum in said formations between said other well and said second well being driven through said formation zone, while said formation zone is in a heated condition, and in the presence of hydrogen therein to cause hydrogenation of said petroleum as it is being driven through said formation zone to said second well, and by way of said second well, recovering said petroleum driven to said second well.

11. The method of claim 10 wherein after said fluids are recovered from said formation zone by way of said second well, injecting additional hydrogen into said formation zone by way of said second well to enhance hydrogenation of said petroleum as it is being driven through said formation zone to said second well.

12. The method of claims 3, 5, 7, or 10 wherein:

said fluid injected into said formations by way of said other well comprises steam.

13. The method of claims 3, 5, 7, or 10 wherein:

said fluid injected into said formations by way of said other well comprises oxygen to cause combustion of petroleum products in said formations to drive fluids including petroleum through said formation zone prior to recovery.

14. The method of claims 3, 5, 7, or 10, wherein:

said fluid injected into said formations by way of said other well comprises oxygen to cause combustion of petroleum products in said formations to drive fluids including petroleum through said formation zone prior to recovery, injecting water into said formations by way of said other well after said combustion process is carried out to produce steam in said formations to drive fluids including petroleum through said formation zone prior to recovery.

15. The method of claims 3, 5, 7, or 10, wherein:

said fluid injected into said formations by way of said other well comprises carbon dioxide.

16. The method of claims 3, 5, 7, or 10, wherein:

said fluid injected into said formations by way of said other well comprises natural gas.

17. The method of claims 3, 5, 7, or 10, wherein:

said fluid injected into said formations by way of said other well comprises methane.

18. The method of claims 3, 5, 7, or 10 wherein:

said fluid injected into said formations by way of said other well comprises propane.

19. The method of claims 3, 5, 7, or 10 wherein:

said fluid injected into said formations by way of said other well comprises ethane.

20. The method of claims 3, 5, 7, or 10 wherein:

said fluid injected into said formations by way of said other well comprises hydrocarbons from the group $C_4$ to $C_{20}$.

21. The method of claims 3, 5, 7, or 10, wherein:

said fluid injected into said formations by way of said other well comprises light petroleum fractions boiling up to saturated steam temperature at the reservoir pressure.

22. A method of recovering petroleum from underground formations penetrated by a production well, comprising the steps of:

by way of said well, injecting into an underground formations zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injecting of said gas, recovering fluids including petroleum from said formation zone by way of said well.

by way of another well penetrating said formations and spaced from said production well, injecting into said formations, fluid comprising steam to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

23. A method of recovering petroleum from underground formations penetrated by a production well, comprising the steps of:

by way of said well, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injection of said gas, recovering fluids including petroleum from said formation zone by way of said well, by way of another well penetrating said formations and spaced from said production well, injecting into said formations, fluid comprising oxygen to cause combustion of petroleum products in said formations to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

24. A method of recovering petroleum from underground formations penetrated by a production well, comprising the steps of:

by way of said well, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injection of said gas, recovering fluids including petroleum from said formation zone by way of said well, by way of another well penetrating said formations and spaced from said production well, injecting into said formations, fluid comprising oxygen to cause combustion of petroleum products in said formations to drive fluids including petroleum in said formations between said other well and said production well, to said production well, injecting water into said formations by way of said other well after said combustion process is carried out to produce steam in said formations to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

25. A method of recovering petroleum from underground formations penetrated by a production well, comprising the steps of:

by way of said well, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injection of said gas, recovering fluids including petroleum from said formation zone by way of said well, by way of another well penetrating said formations and spaced from said production well, injecting into said formations, fluid comprising carbon dioxide to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

26. A method of recovering petroleum from underground formations penetrated by a production well, comprising the steps of:

by way of said well, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injection of said gas, recovering fluids including petroleum from said formation zone by way of said well, by way of another well penetrating said formations and spaced from said production well, injecting into said formations, fluid comprising natural gas to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

27. A method of recovering petroleum from underground formations penetrated by a production well, comprising the steps of:

by way of said well, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injection of said gas, recovering fluids including petroleum from said formation zone by way of said well, by way of another well pentrating said formations and spaced from said production well, injecting into said formations, fluid comprising methane to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

28. A method of recovering petroleum from underground formations penetrated by a production well, comprising the steps of:

by way of said well, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injection of said gas, recovering fluids including petroleum from said formation zone by way of said well, by way of another well penetrating said formations and spaced from said production well, injecting into said formation, fluid comprising propane to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

29. A method of recovering petroleum from underground formations penetrated by a production well, comprising the steps of:

by way of said well, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injection of said gas, recovering fluids including petroleum from said formation zone by way of said well, by way of another well penetrating said formations and spaced from said production well, injecting into said formations, fluid comprising ethane to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

30. A method of recovering petroleum from underground formations penetrated by a production well, comprising the steps of:

by way of said well, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injection of said gas, recovering fluids lncluding petroleum from said formation zone by way of said well, by way of another well penetrating said formations and spaced from said production well, injecting into said formation, fluid comprising hydrocarbons from the group $C_4$ to $C_{20}$ to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

31. A method of recovering petroleum from underground formations penetrated by a production well, comprising the steps of:

by way of said well, injecting into an underground formation zone next to said well, a gas comprising hydrogen, said gas injected having a temperature within a range of from about 350° F. to about 900° F., continuing to inject said gas until sufficient pressure is achieved to cause hydrogenation of the petroleum in said formation zone, terminating the injection of said gas, recovering fluids including petroleum from said formation zone by way of said well, by way of another well penetrating said formations and spaced from said production well, injecting into said formations, fluid comprising light petroleum fractions boiling up to saturated steam temperature at the reservoir pressure to drive fluids including petroleum in said formations between said other well and said production well, to said production well, said petroleum in said formations between said other well and said production well being driven through said formation zone, while said formation zone is in a heated condition, and in the presence of hydrogen therein to cause hydrogenation of said petroleum as it is being driven through said formation zone to said production well, and by way of said production well, recovering said petroleum driven to said production well.

32. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient presssure is achieved to cause hydrogenation of the petroleum in said formation zone, terminating the injection of said hydrogen, recovering fluids including petroleum from said formation zone by way of said well, by way of another well penetrating said formations and spaced from said production well, injecting into said formation, fluid comprising steam to drive fluids including petroleum in said formations between said other well and said production well, to said production well, said petroleum in said formations between said other well and said production well being driven through said formation zone, while said formation zone is in a heated condition and in the presence of hydrogen therein to cause hydrogenation of said petroleum as it is being driven through said formation zone to said production well, and by way of said production well, recovering said petroleum driven to said production well.

33. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the petroleum in said formation zone, terminating the injection of said hydrogen, recovering fluids including petroleum from said formation zone by way of said well, by way of another well penetrating said formations and spaced from said production well, injecting into said formations, fluids comprising oxygen to cause combustion of petroleum products in said formations to drive fluids including petroleum in said formations between said other well and said production well, to said production well, said petroleum in said formations between said other well and said production well being driven through said formation zone, while said formation zone is in a heated condition and in the presence of hydrogen therein to cause hydrogenation of said petroleum as it is being driven through said formation zone to said production well, and by way of said production well, recovering said petroleum driven to said production well.

34. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the petroleum in said formation zone, terminating the injection of said hydrogen, recovering fluids including petroleum from said formation zone by way of said well, by way of another well penetrating said formations and spaced from said production well, injecting into said formations, fluid comprising oxygen to cause combustion of petroleum products in said formations to drive fluids including petroleum in said formations between said other well and said production well, to said production well, injecting water into said formations by way of said other well after said combustion process is carried out to produce steam in said formations to drive fluids including petroleum in said formations between said other well and said production well, to said production well, said petroleum in said formations between said other well and said production well being driven through said formation zone, while said formation zone is in a heated condition and in the presence of hydrogen therein to cause hydrogenation of said petroleum as it is being driven through said formation zone to said production well, and by way of said production well, recovering said petroleum driven to said production well.

35. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the petroleum in said formation zone, terminating the injection of said hydrogen, recovering fluids including petroleum from said formation zone by way of said well, by way of another well pentrating said formations and spaced from said production well, injecting into said formations, fluid comprising carbon dioxide to drive fluids including petroleum in said formations between said other well and said production well, to said production well, said petroleum in said formations between said other well and said production well being driven through said formation zone, while said formation zone is in a heated condition and in the presence of hydrogen therein to cause hydrogenation of said petroleum as it is being driven through said formation zone to said production well, and by way of said production well, recovering said petroleum driven to said production well.

36. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the Petroleum in said formation zone, terminating the injection of said hydrogen, recovering fluids including petroleum from said formation zone by way of said well, by way of another well penetrating said formations and spaced from said production well, injecting into said formations, fluid comprising natural gas to drive fluids including petroleum in said formations between said other well and said production well, to said production well, said petroleum in said formations between said other well and said production well being driven through said formation zone, while said formation zone is in a heated condition and in the presence of hydrogen therein to cause hydrogenation of said petroleum as it is being driven through said formation zone to said production well, and by wayof said production well, recovering said petroleum driven to said production well.

37. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the petroleum in said formation zone, terminating the injection of said hydrogen, recovering fluids including petroleum from said formation zone by way of said well, by way of another well pentrating said formations and spaced from said production well, injecting into said formations, fluid comprising methane to drive flluids including petroleum in said formations between said other well and said production well, to said production well, said petroleum in said formations between said other well and said production well being driven through said formation zone, while said formation zone is in a heated condition and in the presence of hydrogen therein to cause hydrogenation of said petroleum as it is being driven through said formation zone to said production well, and by way of said production well, recovering said petroleum driven to said production well.

38. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the petroleum in said formation zone, terminating the injection of said hydrogen, recovering fluids including petroleum from said formation zone by way of said well, by way of another well penetrating said formations and spaced from said production well, injecting into said formations, fluid comprising propane to drive fluids including petroleum in said formations between said other well and said production well, to said production well, said petroleum in said formations between said other well and said production well being driven through said formation zone, while said formation zone is in a heated condition and in the presence of hydrogen therein to casue hydrogenation of said petroleum as it is being driven through said formation zone to said production well, and by way of said production well, recovering said petroleum driven to said production well.

39. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the petroleum in said formation zone, terminating the injection of said hydrogen, recovering fluids including petroleum from said formation zone by way of said well, by way of another well penetrating said formations and spaced from said production well, injecting into said formations, fluid comprising ethane to drive fluids including petroleum in said formations between said other well and said production well, to said production well, said petroleum in said formations between said other well and said production well being driven through said formation zone, while said formation zone is in a heated condition and in the presence of hydrogen therein to cause hydrogenation of said petroleum as it is being driven through said formation zone to said production well, and by way of said production well, recovering said petroleum driven to said production well.

40. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the petroleum in said formation zone, terminating the injection of said hydrogen, recovering fluids including petroleum from said formation zone by way of said well, by way of another well penetrating said formations and spaced from said production well, injecting into said formations, fluid comprising hydrocarbons from the group $C_4$ to $C_{20}$ to drive fluids including petroleum in said formations between said other well and said production well, to said production well, said petroleum in said formations between said other well and said production well being driven through said formation zone, while said formation zone is in a heated conditon and in the presnece of hydrogen therein to cause hydrogenation of said petroleum as it is being driven through said formation zone to said production well, and by way of said production well, recovering said petroleum driven to said production well.

41. A method of recovering petroleum from underground formations penetrated by a production well, comprising the steps of:

by way of said well, injecting into an underground formation zone next to said well, superheated steam at a temperature within a range of from about 350° F. to about 900° F., reducing the amount of superheated steam injected and injecting into said underground formation zone hydrogen having a temperature within a range of from about 350° F. to about 900° F., continuing to inject said hydrogen until sufficient pressure is achieved to cause hydrogenation of the petroleum in said formation zone, terminating the injection of said hydrogen, recovering fluids including petroleum from said formation zone by way of said well, by way of another well penetrating said formations and spaced from said production well, injecting into said formations, fluid comprising light petroleum fractions boiling up to saturated steam temperature at the reservoir pressure to drive fluids including petroleum in said formations between said other well and said production well, to said production well, said petroleum in said formations between said other well and said production well being driven through said formation zone, while said formation zone is in a heated condition and in the presence of hydrogen therein to cause hydrogenation of said petroleum as it is being driven through said formation zone to said production well, and by way of said production well, recovering said petroleum driven to said production well.

* * * * *